US006095332A

United States Patent [19]

Finand et al.

[11] Patent Number: 6,095,332

[45] **Date of Patent: *Aug. 1, 2000**

[54] STACKABLE CANISTER FOR FLUID UNDER PRESSURE

[75] Inventors: Daniel Finand, Venissieux; Gérard Scremin, Bron, both of France

[73] Assignee: Application Des Gaz, Paris, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/994,749

[22] Filed: Dec. 19, 1997

[30] Foreign Application Priority Data

Dec. 20, 1996 [FR] France ..... 96 16068

[51] Int. Cl.[7] ..... B65D 21/00

[52] U.S. Cl. ..... 206/503; 206/509; 206/511; 206/520

[58] Field of Search ..... 206/509, 511, 206/503, 520; 220/427, 906, 623; 25/10

[56] References Cited

U.S. PATENT DOCUMENTS

| | | | |
|---|---|---|---|
| 526,940 | 10/1894 | Pettit et al. | 215/10 |
| 2,960,248 | 11/1960 | Kuhlman | 215/10 |
| 3,387,749 | 6/1968 | Godshalk et al. | 215/10 |
| 3,731,838 | 5/1973 | Gedde | 220/623 |
| 3,955,705 | 5/1976 | Dubois et al. | 206/509 |
| 4,685,582 | 8/1987 | Pulciani et al. | 206/509 |

FOREIGN PATENT DOCUMENTS

| | | | |
|---|---|---|---|
| 0390711 | 10/1990 | European Pat. Off. . | |
| 1012620 | 7/1952 | France | 206/509 |
| 2548758 | 1/1985 | France . | |

*Primary Examiner*—Gregory M. Vidovich
*Assistant Examiner*—Maerena W. Brevard
*Attorney, Agent, or Firm*—Kramer Levin Naftalis & Frankel LLP

[57] ABSTRACT

A canister includes a substantially cylindrical body having (i) a sidewall shell; (ii) a transition region; (iii) a dome portion extending from a convex annular portion to define at least a partially closed dome at one end of the body cylinder; (iv) and an opposing, open end of the cylindrical body; and a curved bottom member recessed within and sealed at a periphery thereof to the sidewall shell at the open end of the cylindrical body. An annular, exterior surface portion of the bottom member bears on an annular, exterior surface portion of the transition region thereby forming a space between and within the annular exterior surface portion of the bottom member and an exterior surface of the dome portion when the canister is stacked on a substantially identical canister.

7 Claims, 2 Drawing Sheets

STACKABLE CANISTER FOR FLUID UNDER PRESSURE

BACKGROUND OF THE INVENTION

The present invention relates to a canister for fluid under pressure, of the disposable or throw-away container type, generally obtained by cutting and pressing of a relatively thin steel sheet which is protected from corrosion and oxidation by, for example, a tin coating or another coating.

By "fluid under pressure" is meant any substance or mixture of substances, in the liquid and/or gaseous state and under pressure. From among these fluids, and by way of example, mention may be made of a liquefied petroleum gas, in the pure state or in a mixture, such as commercial butane, having two phases, a liquid phase and a gas phase, under a pressure greater than atmospheric pressure and equal to the vapor pressure of the liquefied gas.

In general, these canisters have, on the one hand, a metal body having substantially the shape of a cylindrical shell, which shell delimits a circular opening at one end and is at least partly closed by a projecting dome at the other end, and, on the other hand, a metal recessed bottom closing the circular opening of the cylindrical shell and fastened in a sealed manner to the metal body by an annular crimp having the shape of an external bead. The latter connects, in a sealed manner, the straight edge of the shell delimiting the circular opening of the metal body to the straight foot of the recessed bottom, covering this straight edge.

From this general definition, it is then possible to distinguish:

- perforatable cartridges, for which the cylindrical shell of the metal body is completely closed by a convex projecting dome at the end opposite the circular opening of said shell; and this projecting dome delimits, at its center, a region intended for the perforation, taking for example the shape of a hollow spherical cupola, in order to interact in a rigid and sealed manner with a perforator belonging to an apparatus for using or consuming the content of the cartridge, for example a cooking hotplate;
- cartridges with a valve, for which the projecting dome has, at its center, an opening which is closed, or designed to be closed in a sealed manner by a valve for drawing off the fluid under pressure, especially a valve of the aerosol-valve type; for example, the axial and circular opening includes a peripheral external bead onto which the annular and peripheral rim of the cup of an aerosol valve.

All these canisters are well known to those skilled in the art, for example in the form of so-called aerosol cartridges. They may be filled in various ways, depending on the machines or equipment used, for example:

- via the circular opening of the cylindrical body, arranged "head down", with subsequent crimping of the recessed bottom;
- via the central opening of the projecting dome, for cartridges with a valve, with subsequent crimping of the valve.

Of course, the present invention relates not only to the canisters defined above but also to these same canisters completely closed and filled with the fluid under pressure.

The present invention will now be introduced, defined and explained with reference to a canister of the cartridge with a valve type, containing, for example, commercial butane under pressure.

Conventionally, such cartridges with a valve comprise, on the one hand, a projecting dome of convex shape and, on the other hand, a recessed, concave or domed, bottom having, in diametral section passing through the axis of the body, the shape of a vault.

With this shape of the projecting dome and of the recessed bottom, stacking two cartridges results in bringing the valve of the lower cartridge into contact with the central part of the recessed bottom of the upper cartridge, limiting moreover the contact of the annular crimp of the upper cartridge with the projecting dome of the lower cartridge.

Under these conditions, two drawbacks may occur:

- the upper cartridge is supported by the lower cartridge essentially in a region of the latter which is relatively poorly resistant to an axial point load, namely the projecting dome having a shape close to a sphere; on account of the charge contained by the cartridge, and therefore of its weight which may be relatively great, this drawback leads in practice to the number of cartridges which can be stacked one on top of another, for example for their storage or transportation, being limited;
- the stacking of at least two cartridges remains relatively unstable; this drawback is akin to the previous one and limits the possibilities of stacking the cartridges in question, for example on a is shelf for displaying these cartridges to customers.

SUMMARY OF THE INVENTION

The object of the present invention is to remedy these drawbacks. More particularly, the object of the present invention is to increase the crushing strength of the cylindrical body of the cartridge, by improving the stability of this same cartridge when it is stacked on another identical or similar cartridge, this being achieved, moreover, without decreasing the strength of the canister with respect to the internal pressure of the fluid which it contains.

In accordance with the present invention, the metal body of a canister includes a transition region of the cylindrical shell going on to the projecting dome, comprising a frustoconical portion designed for centering on the inside of the straight foot of the recessed bottom of another canister, itself stacked on the canister in question, and then an adjacent convex, especially rounded, annular portion designed for bearing on a concave annular portion of the recessed bottom, the latter portion itself being adjacent to the straight foot of the other canister which is stacked on the canister in question. Moreover, the projecting dome and the recessed bottom are designed, in terms of shapes and sizes, to fit together so as, in the stacked position of said canister and of said other canister, to leave a stacking gap which is substantially closed along a circular line, spacing apart or separating the projecting dome of said canister from the recessed bottom of said other canister.

Preferably, for a cartridge with a valve, this stacking gap contains the valve of the canister on which said other canister is stacked.

According to a preferred embodiment of the present invention, the projecting dome of the metal body includes a frustoconical part extending from the transition region of said body, optionally to the opening of the projecting dome in the case of a canister or cartridge of the cartridge with a valve type.

The present invention affords other important advantages.

For the same volume, the developed surface of the metal body is relatively smaller, which allows a smaller height with regard to the cylindrical shell and, consequently, a smaller quantity of sheet in order to obtain said body.

In the case of two stacked cartridges or canisters, the line or region of contact is lower down compared to two cartridges stacked according to the prior art, which makes it possible to use cartons for grouping them together which are of smaller height, here again using less material for the packaging.

By virtue of the invention, a relatively heavy cartridge may rest in a stable manner on an identical cartridge, without crushing or deforming the cylindrical body of the latter. Under these conditions, it becomes possible to group the cartridges together in the same packaging, one on top of another, without providing boards inserted between a lower row of cartridges and an upper row of cartridges. This also represents a not inconsiderable saving with regard to the packaging of such cartridges.

Overall, cartridges according to the invention may be grouped together and packaged so as to minimize the dead spaces.

On account of the fact that the shape of the transition region of the cylindrical shell of the metal body approaches that of a sphere, this region appears particularly resistant, in particular with respect to crushing, making it possible to bear on this region when filling, using a filling head for example, without deforming the cylindrical body.

BRIEF DESCRIPTION OF THE DRAWINGS

The present invention is now described with reference to the appended drawing in which.

DETAILED DESCRIPTION OF THE PREFERRED EMBODIMENTS

Figure 1:
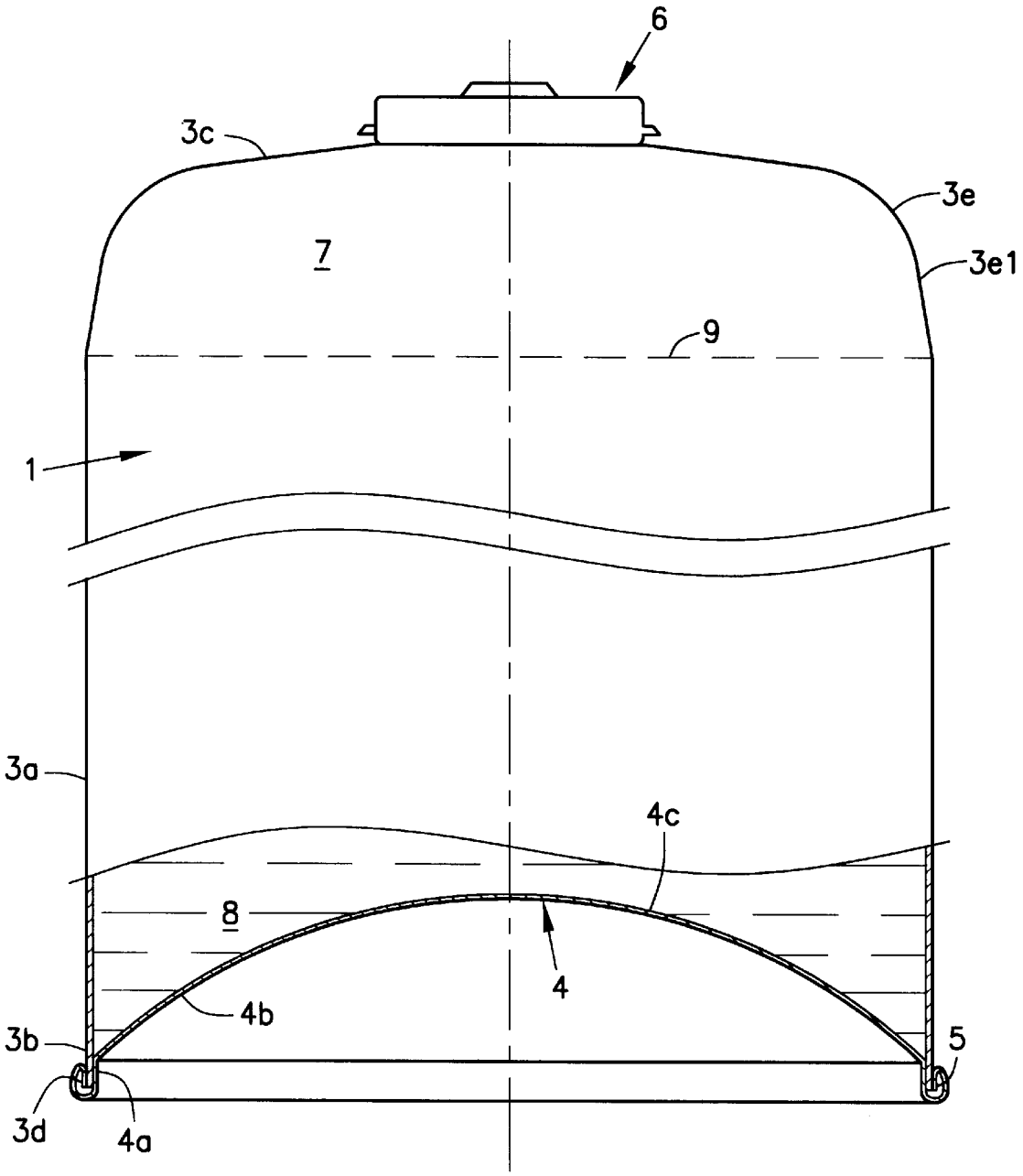
FIG. 1 represents a cartridge or canister in accordance with the present invention, seen in axial cross section.
Figure 2:
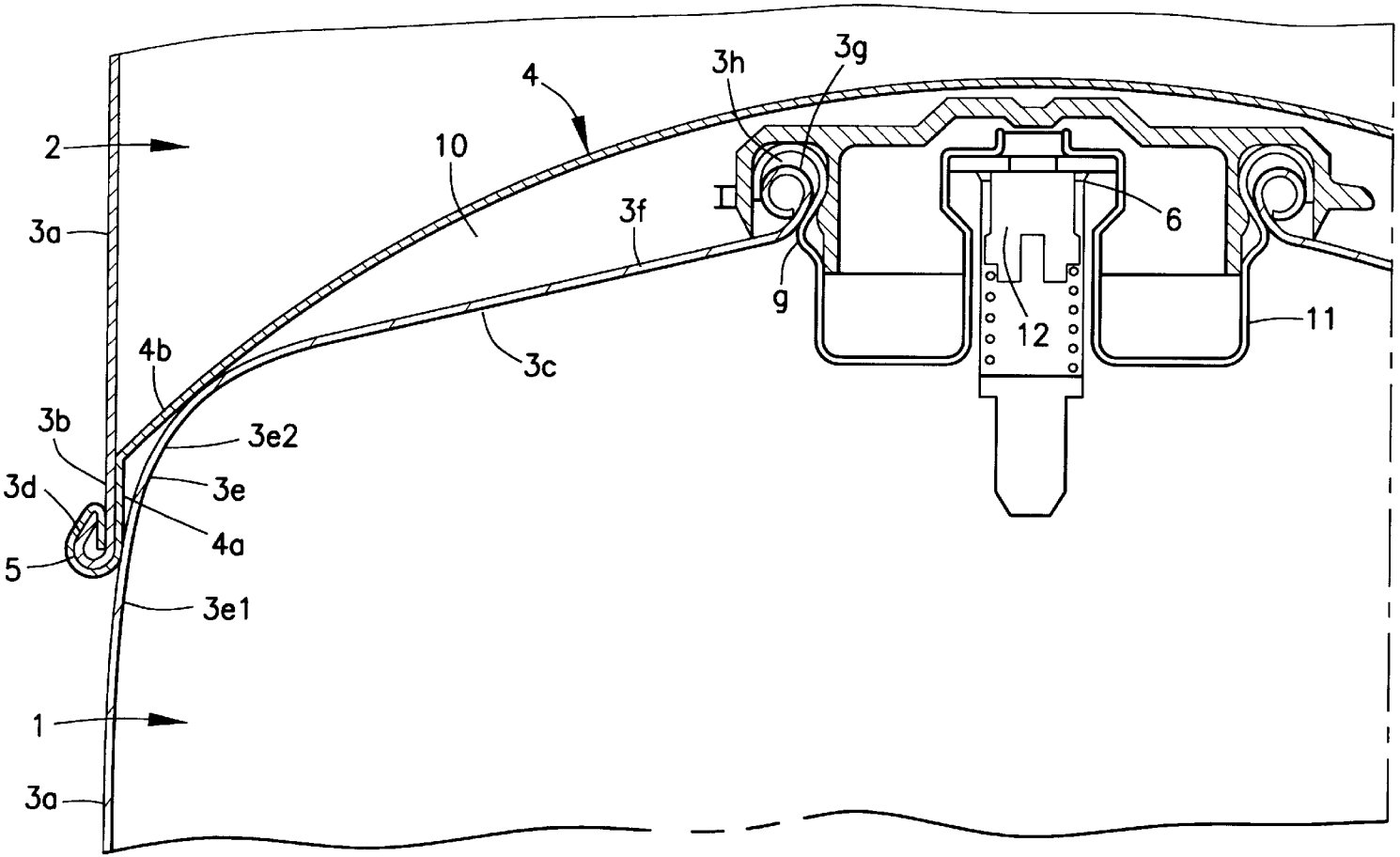
FIG. 2 represents, still in axial cross section, and in a partial view, two cartridges, one stacked on the other, the representation being limited to the lower part of the upper cartridge and to the upper part of the lower cartridge.

In accordance with FIGS. 1 and 2, a cartridge with a valve, containing commercial butane under pressure, consists of a canister 1 or 2, closed in a sealed manner, in which the charge of commercial butane defines an interface 9 between the actual liquid phase 8 and the ceiling of gas 7.

This canister more particularly includes:

- a metal body 3 having substantially the shape of a cylindrical shell 3*a*, which shell delimits a circular opening 3*b* at one end and is at least partly closed by a projecting dome 3*c* at the other end, said projecting dome having, at its center, an axial opening 3*g* closed by the valve 6 for drawing off the fluid under pressure, of the aerosol type, this valve being described hereinbelow;
- a metal recessed bottom 4 closing the circular opening 3*b* of the cylindrical shell 3*a*; this recessed bottom includes a straight foot 4*a* joined directly to a vault 4*c* having a transverse and diametral profile which is elliptical;
- an annular crimp 5 fastening, in a sealed manner, the recessed bottom 4 and the body 3, having the shape of an external bead; this crimp connects the straight edge 3*d* of the shell 3*a* delimiting the circular opening 3*b* to the straight foot *4a* of the recessed bottom 4, covering said straight edge 3*d* of the shell;
- a draw-off valve 6 which includes a cup 11 crimped onto a bead 3*h*, closing the opening 3*g*; this valve, for example of the "female" type, includes a valve closure member 12 constituting the valve proper.

In accordance with the present invention, and with reference to FIG. 2, the metal body 3 includes a transition region 3*e* of the cylindrical shell going on to the projecting dome 3*c*, and including, in succession, a frustoconical portion 3*e*1 designed for centering on the inside of the straight foot 4*a* of the recessed bottom 4 of another canister 2 stacked on said canister 1, and then an adjacent, rounded, convex annular portion 3*e*2 designed for bearing on a concave annular portion 4*b* of the recessed bottom 4, the latter portion being adjacent to the straight foot of said other canister 2. Furthermore, the projecting dome 3*c* and the recessed bottom 4 are designed, in terms of shapes and sizes, to fit together so as, in the stacked position, as shown in FIG. 2, of said other canister 2 on said canister 1, to leave a stacking gap 10 which is substantially closed along a circular line of contact between the convex annular portion 3*e*2 and the concave annular portion 4*b*. This stacking gap 10 separates or spaces apart the projecting dome 3*c* of the canister 1 from the recessed bottom 4 of said other canister 2.

Moreover, the projecting dome 3*c* includes a frustoconical part 3*f* extending from the transition region 3*e* of the metal body to the central opening 3*g*.

The stability of cartridges according to the invention, compared to that of conventional cartridges or cartridges according to the prior art, has been measured by measuring, in the case of two stacked cartridges, the limiting angle, before the upper cartridge tips over, the two stacked cartridges being placed together on a plane which is progressively inclined.

By virtue of the invention, in the case of a cartridge containing 270 grams of butane gas, the solution according to the invention makes it possible to increase the limiting tilt angle from 2.5° to 30°. In the case of a cartridge containing about 470 grams, the solution according to the invention makes it possible to increase the limiting tilt angle from 3.5° to 21°.

What is claimed is:

1. A stackable canister comprising:

a substantially cylindrical shell having upper and lower ends;

a transition region integral with said upper end of said shell, said transition region being a first frustoconical portion extending from said upper end of said shell, and a convex portion extending from said first frustoconical portion;

a projecting dome including a second frustoconical portion extending from said convex portion;

a substantially annular opening defined by said lower end of said shell; and a curved bottom member recessed within said annular opening at said lower end of said shell, said member being fastened to said lower end of said shell in a sealed manner along a periphery of said member, said member having a substantially concave exterior surface;

wherein, in the stacking of substantially identical canisters, said convex portion of said transition region bears on the exterior surface of the bottom member of a substantially identical canister along an annular line of contact between said convex portion of said transition region and the exterior surface of the bottom member of the substantially identical canister, such that a gap is defined by said projecting dome and the exterior surface of the bottom member of the substantially identical canister.

2. The canister as claimed in claim 1, wherein said bottom member includes a downwardly extending foot formed at said periphery of said bottom member, and said opening of said lower end of said shell includes an annular bead, said foot and said bead being crimped together to fasten said bottom member to said shell.

3. The canister as claimed in claim 1, wherein said dome includes an axial opening.

4. The canister as claimed in claim 3, further comprising a cup fastened to said axial opening of said dome.

5. The canister as claimed in claim 4, further comprising a valve within said cup.

6. The canister as claimed in claim 1, wherein said dome includes a perforation region.

7. The canister as claimed in claim 1, wherein said bottom member and said shell form an exterior cavity having a substantially elliptical profile.

* * * * *